US011767846B2

(12) United States Patent
Berning

(10) Patent No.: US 11,767,846 B2
(45) Date of Patent: Sep. 26, 2023

(54) COMPRESSOR HAVING SEAL ASSEMBLY

(71) Applicant: Emerson Climate Technologies, Inc., Sidney, OH (US)

(72) Inventor: Jeffrey L. Berning, Fort Loramie, OH (US)

(73) Assignee: Copeland LP, Sidney, OH (US)

( * ) Notice: Subject to any disclaimer, the term of this patent is extended or adjusted under 35 U.S.C. 154(b) by 79 days.

(21) Appl. No.: 17/154,716

(22) Filed: Jan. 21, 2021

(65) Prior Publication Data

US 2022/0228590 A1 Jul. 21, 2022

(51) Int. Cl.

| | |
|---|---|
| ***F04C 27/00*** | (2006.01) |
| ***F04C 29/06*** | (2006.01) |
| ***F04C 18/02*** | (2006.01) |
| ***F04C 29/12*** | (2006.01) |

(52) U.S. Cl.

CPC ..... *F04C 27/005* (2013.01); *F04C 18/0215* (2013.01); *F04C 29/068* (2013.01); *F04C 29/124* (2013.01)

(58) Field of Classification Search

CPC ..... F04C 18/0207–0292; F04C 27/005; F04C 18/0215; F04C 29/065; F04C 29/068; F04C 29/124; F04C 29/126; F04C 28/06; F04C 28/24; F04C 29/0021; F04C 29/0028; F04C 29/0035

See application file for complete search history.

(56) References Cited

U.S. PATENT DOCUMENTS

| | | | |
|---|---|---|---|
| 2,294,105 | A | 8/1942 | Wallgren |
| 2,592,082 | A | 4/1952 | Trumpler |
| 2,867,462 | A | 1/1959 | Nielsen |

(Continued)

FOREIGN PATENT DOCUMENTS

| | | | |
|---|---|---|---|
| CN | 1060699 | A | 4/1992 |
| CN | 1113547 | A | 12/1995 |

(Continued)

OTHER PUBLICATIONS

Non-Final Office Action regarding U.S. Appl. No. 16/864,987 dated Mar. 15, 2022.

(Continued)

*Primary Examiner* — Mark A Laurenzi
*Assistant Examiner* — Xiaoting Hu
(74) *Attorney, Agent, or Firm* — Harness, Dickey & Pierce, P.L.C.

(57) ABSTRACT

A compressor includes a shell, a muffler plate, first and second scroll members, and first and second sealing members. The shell defines first and second pressure regions separated by the muffler plate. The first scroll member includes a first end plate and a first scroll wrap. The first end plate defines an annular recess and a discharge recess. The discharge recess is in communication with the first pressure region. The second scroll member includes a second end plate and a second scroll wrap. The second scroll wrap meshingly engages the first scroll wrap to define a compression chamber therebetween. The first sealing member is at least partially disposed in the discharge passage and fluidly separates the first and second pressure regions from each other. The second sealing member is at least partially disposed in the annular recess.

16 Claims, 7 Drawing Sheets

(56) References Cited

U.S. PATENT DOCUMENTS

| | | | | |
|---|---|---|---|---|
| 3,306,683 | A | 2/1967 | Deuring | |
| 3,511,512 | A | 5/1970 | Wheelock | |
| 3,600,114 | A | 8/1971 | Dvorak et al. | |
| 3,707,852 | A | 1/1973 | Burckhardt et al. | |
| 4,116,452 | A | 9/1978 | Schanz | |
| 4,596,520 | A | 6/1986 | Arata et al. | |
| 4,655,462 | A | 4/1987 | Balsells | |
| 4,669,737 | A | 6/1987 | Diffenderfer | |
| 4,869,514 | A | 9/1989 | Bogdanovic | |
| 4,877,382 | A | 10/1989 | Caillat et al. | |
| 4,940,080 | A | 7/1990 | Reeves et al. | |
| 4,993,928 | A | 2/1991 | Fraser, Jr. | |
| 5,105,879 | A | 4/1992 | Ross | |
| 5,156,539 | A | 10/1992 | Anderson et al. | |
| 5,311,748 | A | 5/1994 | Bahel et al. | |
| 5,342,183 | A | 8/1994 | Rafalovich et al. | |
| 5,407,335 | A | 4/1995 | Caillat et al. | |
| 5,435,707 | A | 7/1995 | Hirano et al. | |
| 5,447,418 | A | 9/1995 | Takeda et al. | |
| 5,447,420 | A | 9/1995 | Caillat et al. | |
| 5,494,422 | A | 2/1996 | Ukai et al. | |
| RE35,216 | E | 4/1996 | Anderson et al. | |
| 5,503,542 | A | 4/1996 | Grassbaugh et al. | |
| 5,540,572 | A | 7/1996 | Park et al. | |
| 5,562,435 | A | 10/1996 | Cho et al. | |
| 5,588,820 | A | 12/1996 | Hill et al. | |
| 5,607,288 | A | 3/1997 | Wallis et al. | |
| 5,613,841 | A | 3/1997 | Bass et al. | |
| 5,707,210 | A | 1/1998 | Ramsey et al. | |
| 5,800,141 | A | 9/1998 | Ceylan et al. | |
| 5,803,716 | A | 9/1998 | Wallis et al. | |
| 5,921,761 | A | 7/1999 | Eckels | |
| 6,027,321 | A | 2/2000 | Shim et al. | |
| 6,048,184 | A | 4/2000 | Chang et al. | |
| 6,059,549 | A | 5/2000 | Tarng et al. | |
| 6,077,057 | A | 6/2000 | Hugenroth et al. | |
| 6,095,765 | A | 8/2000 | Khalifa | |
| 6,135,739 | A | 10/2000 | Ogawa et al. | |
| 6,146,119 | A | 11/2000 | Bush et al. | |
| 6,164,660 | A | 12/2000 | Goodman | |
| 6,171,088 | B1 | 1/2001 | Sun et al. | |
| 6,267,565 | B1 | 7/2001 | Seibel et al. | |
| 6,419,457 | B1 | 7/2002 | Seibel et al. | |
| 6,631,685 | B2 | 10/2003 | Hewitt | |
| 6,821,092 | B1 | 11/2004 | Gehret et al. | |
| 6,913,448 | B2 | 7/2005 | Liang et al. | |
| 6,984,115 | B1 | 1/2006 | Tarng et al. | |
| 7,070,401 | B2 | 7/2006 | Clendenin et al. | |
| 7,140,851 | B2 | 11/2006 | Tarng | |
| 7,338,265 | B2 | 3/2008 | Grassbaugh et al. | |
| 7,491,045 | B2 | 2/2009 | Masuda | |
| 7,543,822 | B2 | 6/2009 | Grimanis et al. | |
| 7,568,897 | B2 | 8/2009 | Grassbaugh et al. | |
| 7,611,345 | B2 | 11/2009 | Huang et al. | |
| 8,033,803 | B2 | 10/2011 | Stover | |
| 8,043,078 | B2 | 10/2011 | Stover et al. | |
| 8,287,257 | B2 | 10/2012 | Dunaevsky | |
| 8,517,703 | B2 * | 8/2013 | Doepker | F04C 18/0253 137/511 |
| 8,932,036 | B2 | 1/2015 | Monnier et al. | |
| 9,121,276 | B2 | 9/2015 | Heidecker et al. | |
| 10,215,175 | B2 | 2/2019 | Ignatiev et al. | |
| 10,975,868 | B2 | 4/2021 | Jorwekar et al. | |
| 2002/0026806 | A1 | 3/2002 | Tsuboe et al. | |
| 2002/0119063 | A1 | 8/2002 | Morozumi | |
| 2003/0012659 | A1 | 1/2003 | Seibel et al. | |
| 2003/0044296 | A1 * | 3/2003 | Chen | F04C 29/126 418/270 |
| 2003/0063982 | A1 | 4/2003 | Pham | |
| 2004/0071571 | A1 | 4/2004 | Uchida et al. | |
| 2004/0136854 | A1 | 7/2004 | Kimura et al. | |
| 2005/0123428 | A1 | 6/2005 | Uchida et al. | |
| 2005/0142017 | A1 | 6/2005 | Liang et al. | |
| 2005/0265880 | A1 * | 12/2005 | Chang | F04C 28/265 418/55.1 |
| 2006/0198748 | A1 * | 9/2006 | Grassbaugh | F04C 27/005 418/55.6 |
| 2007/0036661 | A1 | 2/2007 | Stover | |
| 2007/0224071 | A1 | 9/2007 | Wang | |
| 2008/0101972 | A1 | 5/2008 | Tarng et al. | |
| 2008/0159895 | A1 | 7/2008 | Huang et al. | |
| 2008/0175737 | A1 | 7/2008 | Grassbaugh et al. | |
| 2009/0060767 | A1 | 3/2009 | Zamudio | |
| 2009/0068048 | A1 * | 3/2009 | Stover | F04C 18/0215 418/142 |
| 2009/0098001 | A1 | 4/2009 | Ni | |
| 2009/0169405 | A1 | 7/2009 | Suefuji et al. | |
| 2009/0185926 | A1 | 7/2009 | Bush | |
| 2009/0185935 | A1 * | 7/2009 | Seibel | F04C 29/124 418/55.4 |
| 2009/0246059 | A1 | 10/2009 | Nakamura et al. | |
| 2010/0254841 | A1 | 10/2010 | Akei et al. | |
| 2010/0303659 | A1 | 12/2010 | Stover et al. | |
| 2011/0293456 | A1 | 12/2011 | Seibel et al. | |
| 2012/0107163 | A1 * | 5/2012 | Monnier | F04C 18/0215 418/55.4 |
| 2012/0148433 | A1 | 6/2012 | Liang et al. | |
| 2012/0258002 | A1 | 10/2012 | Rose | |
| 2013/0078128 | A1 | 3/2013 | Akei | |
| 2014/0023541 | A1 | 1/2014 | Heidecker et al. | |
| 2014/0271306 | A1 | 9/2014 | Kim et al. | |
| 2015/0316055 | A1 | 11/2015 | Jin et al. | |
| 2015/0316058 | A1 | 11/2015 | Jin et al. | |
| 2016/0025094 | A1 | 1/2016 | Ignatiev et al. | |
| 2019/0010944 | A1 * | 1/2019 | Jorwekar | F16J 15/443 |
| 2019/0178250 | A1 | 6/2019 | DeFord et al. | |

FOREIGN PATENT DOCUMENTS

| | | | |
|---|---|---|---|
| CN | 1184894 | A | 6/1998 |
| CN | 1286358 | A | 3/2001 |
| CN | 1415913 | A | 5/2003 |
| CN | 1576605 | A | 2/2005 |
| CN | 1828022 | A | 9/2006 |
| CN | 101046204 | A | 10/2007 |
| CN | 102449313 | A | 5/2012 |
| CN | 203214294 | U | 9/2013 |
| CN | 104061157 | A | 9/2014 |
| CN | 209180006 | U | 7/2019 |
| EP | 0482209 | A1 | 4/1992 |
| EP | 0747598 | A2 | 12/1996 |
| EP | 1698784 | B1 | 3/2013 |
| JP | H05149269 | A | 6/1993 |
| JP | H06346871 | A | 12/1994 |
| JP | H08296572 | A | 11/1996 |
| JP | H09329090 | A * | 12/1997 |
| JP | 2001082354 | A * | 3/2001 |
| KR | 20020030018 | A | 4/2002 |
| KR | 20180065340 | A | 6/2018 |
| RU | 2064050 | C1 | 7/1996 |
| WO | WO-2009035640 | A1 | 3/2009 |
| WO | WO-2016049464 | A1 | 3/2016 |

OTHER PUBLICATIONS

Non-Final Office Action regarding U.S. Appl. No. 15/930,616 dated Apr. 26, 2022.

International Search Report from the ISA regarding Application No. PCT/US2021/029179 dated Aug. 2, 2021.

Written Opinion of the ISA regarding Application No. PCT/US2021/029179 dated Aug. 2, 2021.

Written Opinion of the ISA regarding Application No. PCT/US2021/032036 dated Aug. 24, 2021.

International Search Report regarding Application No. PCT/US2021/032036 dated Aug. 24, 2021.

International Search Report regarding Application No. PCT/US2021-033899 dated Sep. 6, 2021.

Written Opinion of the ISA regarding Application No. PCT/US2021/033899 dated Sep. 6, 2021.

Non-Final Office Action regarding U.S. Appl. No. 16/883,323 dated Feb. 2, 2022.

(56) References Cited

OTHER PUBLICATIONS

International Search Report regarding Application No. PCT/US2022/013142 dated May 3, 2022.
Written Opinion regarding Application No. PCT/US2022/013142 dated May 3, 2022.
U.S. Appl. No. 16/864,987, filed May 1, 2020, James W. McBean et al.
U.S. Appl. No. 15/930,616, filed May 13, 2020, Yogesh S. Mahure.
U.S. Appl. No. 16/883,323, filed May 26, 2020, James A. Schaefer et al.
International Search Report regarding International Application No. PCT/US2011/058128, dated Apr. 10, 2012.
Written Opinion of the International Searching Authority regarding International Application No. PCT/US2011/058128, dated Apr. 10, 2012.
Office Action regarding U.S. Appl. No. 13/283,097, dated Jan. 30, 2014.
Office Action regarding Russian Patent Application No. 2013124425, dated Jun. 9, 2014. Translation provided by Gowlings International Inc.
Office Action regarding U.S. Appl. No. 13/283,097, dated Jul. 9, 2014.
Office Action regarding Chinese Patent Application No. 201180052695.2, dated Feb. 2, 2015. Translation provided by Unitalen Attorneys at Law.
Office Action regarding Chinese Patent Application No. 201180052695.2, dated Oct. 9, 2015. Translation provided by Unitalen Attorneys at Law.
Office Action regarding Chinese Patent Application No. 201180052695.2, dated Mar. 17, 2016. Translation provided by Unitalen Attorneys at Law.
Search Report regarding European Patent Application No. 11837109.5, dated Jun. 8, 2016.
Office Action regarding European Patent Application No. 11837109.5, dated Nov. 17, 2017.
Office Action regarding Chinese Patent Application No. 201610608786.4, dated Jan. 23, 2018. Translation provided by Unitalen Attorneys at Law.
Office Action regarding Indian Patent Application No. 735/MUMNP/2013, dated Jun. 6, 2018.
Office Action regarding Chinese Patent Application No. 201610608786.4, dated Sep. 10, 2018. Translation provided by Unitalen Attorneys at Law.
Office Action regarding Chinese Patent Application No. 201810735714.5, dated Jun. 3, 2019. Translation provided by Unitalen Attorneys at Law.
Office Action regarding European Patent Application No. 11837109.5, dated Jun. 18, 2019.
Office Action regarding Chinese Patent Application No. 201810735714.5, dated Nov. 27, 2019. Translation provided by Unitalen Attorneys at Law.
Office Action regarding Indian Patent Application No. 201721023952, dated Nov. 27, 2019.
Office Action regarding European Patent Application No. 11837109.5, dated Mar. 9, 2020.
Restriction Requirement regarding U.S. Appl. No. 16/025,050, dated Jun. 5, 2020.
Office Action regarding U.S. Appl. No. 16/025,050, dated Jul. 27, 2020.
Office Action regarding Indian Patent Application No. 201824024885, dated Aug. 11, 2020.
Notice of Allowance regarding U.S. Appl. No. 16/025,050, dated Dec. 24, 2020.
Office Action regarding European Patent Application No. 11837109.5, dated Apr. 26, 2021.
Final Office Action regarding U.S. Appl. No. 16/883,323 dated Jul. 29, 2022.
Final Office Action regarding U.S. Appl. No. 16/864,987 dated Aug. 16, 2022.
Final Office Action regarding U.S. Appl. No. 15/930,616 dated Aug. 5, 2022.

* cited by examiner

COMPRESSOR HAVING SEAL ASSEMBLY

FIELD

The present disclosure relates to a compressor having a seal assembly.

BACKGROUND

This section provides background information related to the present disclosure and is not necessarily prior art.

Heat-pump systems and other working fluid circulation systems include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Efficient and reliable operation of the compressor is desirable to ensure that the heat-pump system in which the compressor is installed is capable of effectively and efficiently providing a cooling and/or heating effect on demand. Compressors used in heat-pump systems utilizing low global warming potential (LGWP) refrigerants must operate at higher temperatures than those utilizing conventional refrigerants due to the higher heat of compression of the LGWP refrigerants. These higher temperatures require improvements in the design of the seals used in such compressors to maintain the desired compression ratios and efficiency.

SUMMARY

This section provides a general summary of the disclosure, and is not a comprehensive disclosure of its full scope or all of its features.

In one form, the present disclosure provides a compressor that includes a shell, a muffler plate, a first scroll member, a second scroll members, and first and second sealing members. The shell defines a first pressure region and a second pressure region. The muffler plate separates the first pressure region and the second pressure region. The first scroll member is disposed within the shell and includes a first end plate and a first scroll wrap. The first end plate defines an annular recess and a discharge recess. The discharge recess is in communication with the first pressure region. The second scroll member includes a second end plate and a second scroll wrap. The second scroll wrap meshingly engaging the first scroll wrap to define a compression chamber therebetween. The first sealing member is at least partially disposed in the discharge recess and fluidly separates the first and second pressure regions from each other. The second sealing member is at least partially disposed in the annular recess. The second sealing member forms a third pressure region that is fluidly isolated from the first and second pressure regions.

In some configurations of the compressor of the above paragraph, the second sealing member includes a first end portion sealingly engaged with an inner wall of the annular recess and a second end portion sealingly engaged with an outer wall of the annular recess.

In some configurations of the compressor of any one or more of the above paragraphs, the second sealing member includes a planar central portion. The first end portion extends radially inwardly and axially downwardly from the planar central portion and the second end portion extends radially outwardly and axially downwardly from the planar central portion.

In some configurations of the compressor of any one or more of the above paragraphs, a spacer is at least partially disposed within the annular recess and includes a first surface contacting the second sealing member and a second surface configured to contact the muffler plate.

In some configurations of the compressor of any one or more of the above paragraphs, the second sealing member is U-shaped.

In some configurations of the compressor of any one or more of the above paragraphs, the first and second sealing members are made of a flexible material.

In some configurations of the compressor of any one or more of the above paragraphs, the first pressure region is a discharge pressure chamber. The second pressure region is a suction pressure chamber and the third pressure region is an intermediate pressure chamber.

In some configurations of the compressor of any one or more of the above paragraphs, the muffler plate includes a flange at least partially extending into the discharge recess and partially defining a discharge opening that provides discharge gas from the discharge recess to the first pressure region.

In some configurations of the compressor of any one or more of the above paragraphs, a spacer is at least partially disposed within the annular recess and is supported by the second sealing member. The spacer is configured to contact the muffler plate during operation of the compressor.

In some configurations of the compressor of any one or more of the above paragraphs, the second sealing member is spaced apart from the muffler plate.

In another form, the present disclosure provides a compressor that includes a shell, a muffler plate, a first scroll member, a second scroll member, and first and second sealing members. The shell defines a first pressure region and a second pressure region. The muffler plate separates the first pressure region and the second pressure region. The first scroll member is disposed within the shell and includes a first end plate and a first scroll wrap. The first end plate defines an annular recess and a discharge recess. The discharge recess is in communication with the first pressure region. The second scroll member includes a second end plate and a second scroll wrap. The second scroll wrap meshingly engages the first scroll wrap to define a compression chamber therebetween. The first sealing member is at least partially disposed in the discharge recess and fluidly separates the first and second pressure regions from each other. The second sealing member is at least partially disposed in the annular recess and spaced apart from the muffler plate. The second sealing member forms a third pressure region that is fluidly isolated from the first and second pressure regions. The muffler plate includes a flange at least partially extending into the discharge recess and partially defining a discharge opening that provides discharge gas from the discharge recess to the first pressure region.

In some configurations of the compressor of the above paragraph, a biasing member is disposed within the discharge recess and biases the first sealing member toward the flange of the muffler plate.

In some configurations of the compressor of any one or more of the above paragraphs, a valve assembly disposed within the discharge recess and including a valve plate and a valve member. The valve plate is coupled to an inside wall of the discharge recess. The valve member is movable between a first position in which fluid in the compression chamber is prevented from flowing to the first pressure region via the valve plate and a second position in which fluid in the compression chamber is allowed to flow to the first pressure region via the valve plate.

In some configurations of the compressor of any one or more of the above paragraphs, a biasing member disposed within the discharge recess between the flange and the valve plate. The biasing member biases the first sealing member toward the flange.

In some configurations of the compressor of any one or more of the above paragraphs, a pressure relief valve is housed within and extending through an outer wall of the first end plate that defines the annular recess. The pressure relief valve is in fluid communication with the third pressure region to control fluid pressure in the third pressure region.

In some configurations of the compressor of any one or more of the above paragraphs, the first sealing member is sealingly engaged with an outer diametrical surface of the flange and an inside wall of the discharge recess.

In some configurations of the compressor of any one or more of the above paragraphs, the first sealing member is V-shaped.

In some configurations of the compressor of any one or more of the above paragraphs, the first sealing member is sealingly engaged with an inside wall of the discharge recess and an axial end surface of the flange of the muffler plate.

In some configurations of the compressor of any one or more of the above paragraphs, the first sealing member is made of a flexible material.

In some configurations of the compressor of any one or more of the above paragraphs, the first sealing member includes an end portion that at least partially extends into the discharge opening of the muffler plate. The first sealing member is moveable downwardly when the compressor is in a shutdown state to allow discharge gas in the first pressure region to flow toward the second pressure region.

In some configurations of the compressor of any one or more of the above paragraphs, a spacer is at least partially disposed within the annular recess and supported by the second sealing member. The spacer includes radially extending grooves that allow discharge gas in the first pressure region to flow toward the second pressure region when the compressor is in the shutdown state.

In some configurations of the compressor of any one or more of the above paragraphs, a biasing member is disposed within the discharge recess and biases the first sealing member toward the flange of the muffler plate. Discharge fluid in the first pressure region overcomes the biasing force of the biasing member when the compressor is in the shutdown state to allow discharge gas in the first pressure region to flow toward the second pressure region.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
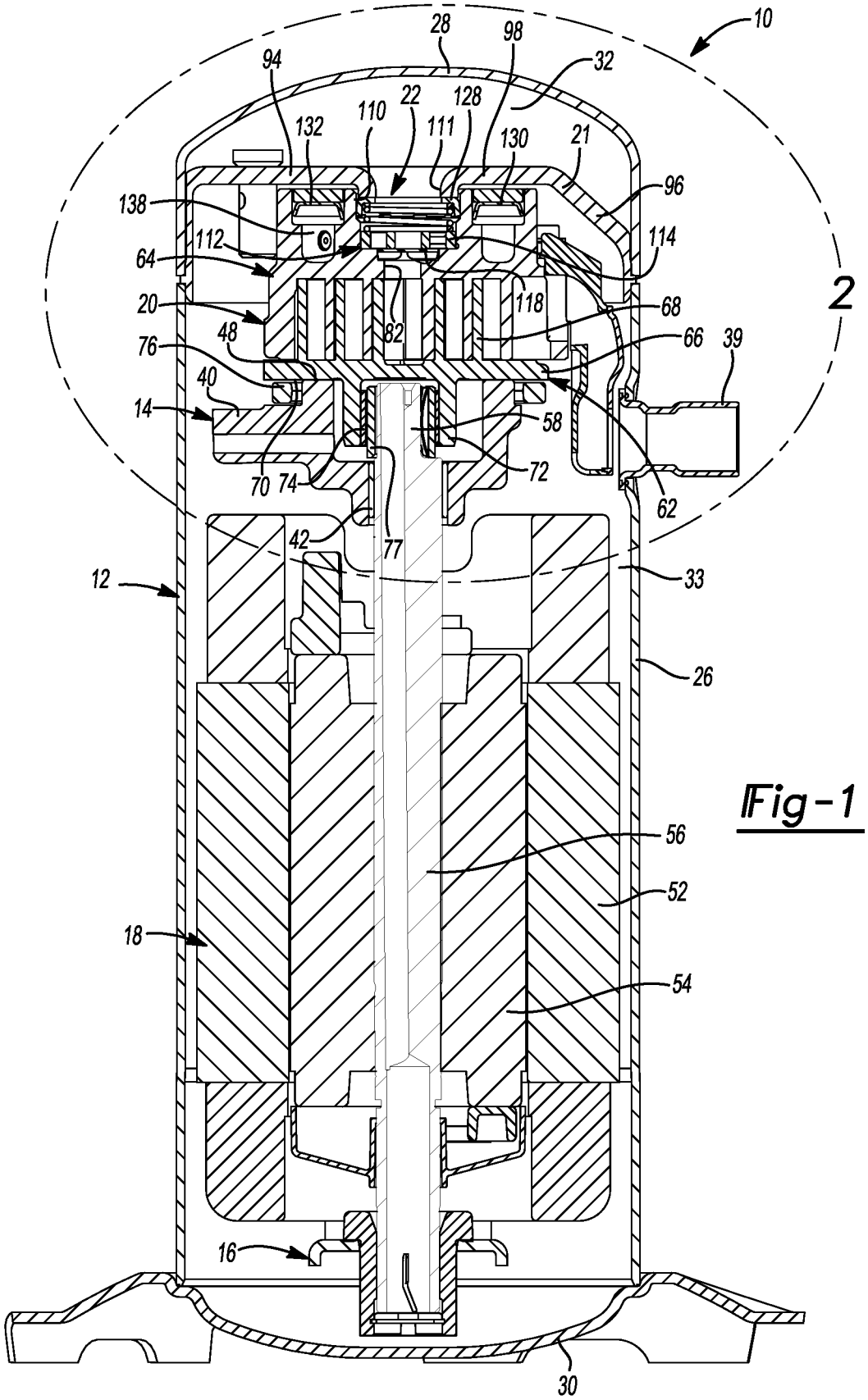
FIG. 1 is a cross-sectional view of a compressor including a seal assembly in accordance with the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As shown in FIG. 1, a compressor 10 is provided that may include a hermetic shell assembly 12, a first bearing housing assembly 14, a second bearing housing assembly 16, a motor assembly 18, a compression mechanism 20, transversely extending partition or muffler plate 21, and a seal assembly 22.

The shell assembly 12 may form a compressor housing and may include a cylindrical shell 26, an end cap 28 at an upper end thereof, and a base 30 at a lower end thereof. The end cap 28 and the partition 21 may define a discharge chamber 32. The partition 21 may separate the discharge chamber 32 from a suction chamber 33. A discharge fitting (not shown) may be attached to the shell assembly 12 at an opening in the end cap 28. A discharge valve assembly (not shown) may be disposed within the discharge fitting and may generally prevent a reverse flow condition. A suction inlet fitting 39 may be attached to shell assembly 12 at an opening 45.

The first bearing housing assembly 14 may be fixed relative to the shell 26 and may include a main bearing housing 40 and a first bearing 42. The main bearing housing 40 may house the first bearing 42 therein and may define an annular flat thrust bearing surface 48 on an axial end surface thereof.

The motor assembly 18 may include a motor stator 52, a rotor 54, and a drive shaft 56. The motor stator 52 may be press fit into the shell 26. The rotor 54 may be press fit on the drive shaft 56 and may transmit rotational power to the drive shaft 56. The drive shaft 56 may be rotatably supported within the first and second bearing housing assemblies 14, 16. The drive shaft 56 may include an eccentric crank pin 58 having a flat thereon.

The compression mechanism 20 may include an orbiting scroll 62 and a non-orbiting scroll 64. The orbiting scroll 62 may include an end plate 66 having a spiral wrap 68 on an upper surface thereof and an annular flat thrust surface 70 on a lower surface. The thrust surface 70 may interface with the annular flat thrust bearing surface 48 on the main bearing housing 40. A cylindrical hub 72 may project downwardly from thrust surface 70 and may include a drive bushing 74 and an unloader bushing 77 disposed therein. The unloader bushing 77 may include an inner bore in which the crank pin 58 is drivingly disposed. The crank pin flat may drivingly engage a flat surface in a portion of the inner bore to provide a radially compliant driving arrangement. An Oldham coupling 76 may be engaged with the orbiting and non-orbiting scrolls 62, 64 to prevent relative rotation therebetween.

With reference to FIGS. 1-4, the non-orbiting scroll 64 may include an end plate 78 and a spiral wrap 80 projecting downwardly from the end plate 78. The spiral wrap 80 may meshingly engage the spiral wrap 68 of the orbiting scroll 62, thereby creating a series of moving fluid pockets. The fluid pockets defined by the spiral wraps 68, 80 may decrease in volume as they move from a radially outer position (at a suction pressure) to a radially intermediate position (at an intermediate pressure) to a radially inner position (at a discharge pressure) throughout a compression cycle of the compression mechanism 20.

As shown in FIGS. 1-4, the end plate 78 may include a discharge passage 82, a discharge recess 84, and an annular recess 88. The discharge passage 82 is in communication with one of the fluid pockets at the radially inner position and allows compressed working fluid (at the discharge pressure) to flow through the discharge recess 84 and into the discharge chamber 32. The annular recess 88 may encircle the discharge recess 84 and may be substantially concentric therewith. The annular recess 88 may include an inner surface 89 and an outer surface 90.

Figure 3:
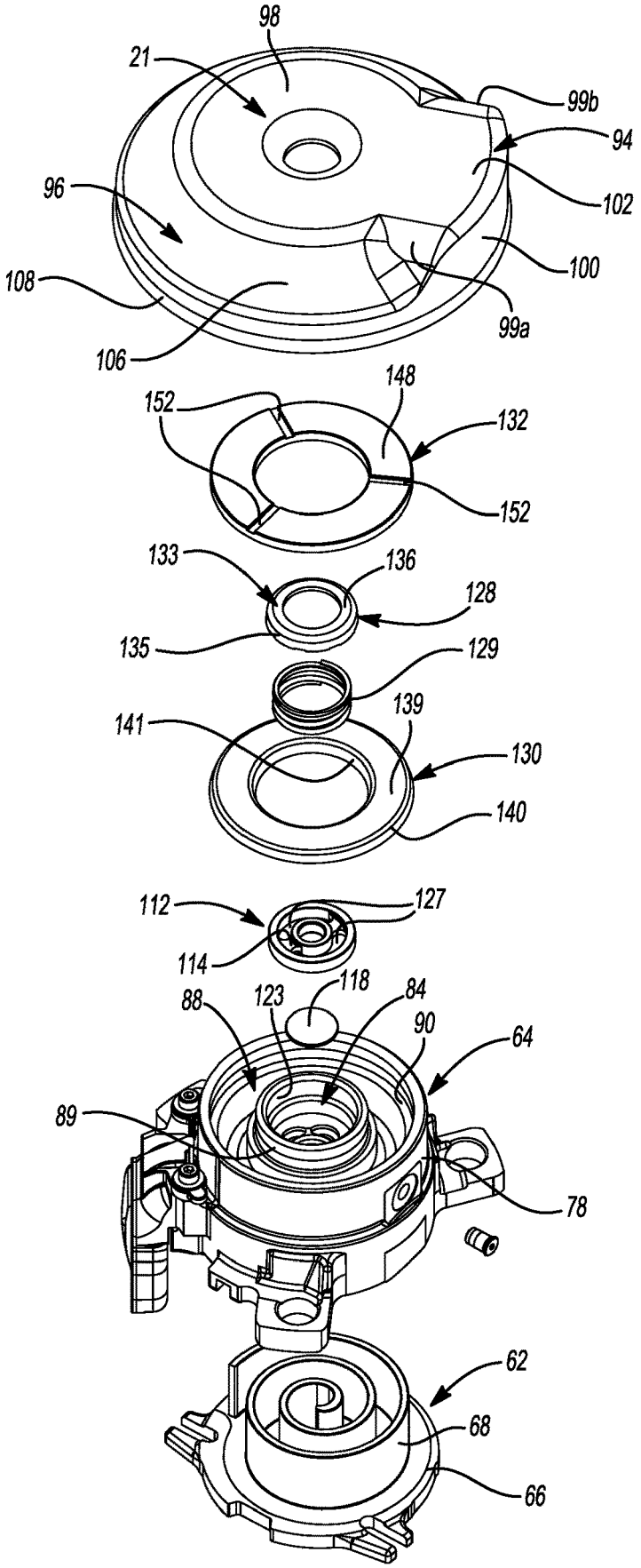
FIG. 3 is an exploded view of a compression mechanism of the compressor and the seal assembly.

As shown in FIG. 3, the partition 21 may include a lobe 94, a wedge 96 and a hub 98. The lobe 94 may extend from the wedge 96 and the hub 98, and may include opposing outer walls 99*a*, 99*b*, an arcuate back wall 100 and a planar upper wall 102. One or more safety devices (e.g., thermally operated valve) may be placed on the planar upper wall 102 of the lobe 94, and may facilitate venting of the discharge chamber 32 when fluid temperatures therein exceed a predetermined threshold, for example.

Figure 2:
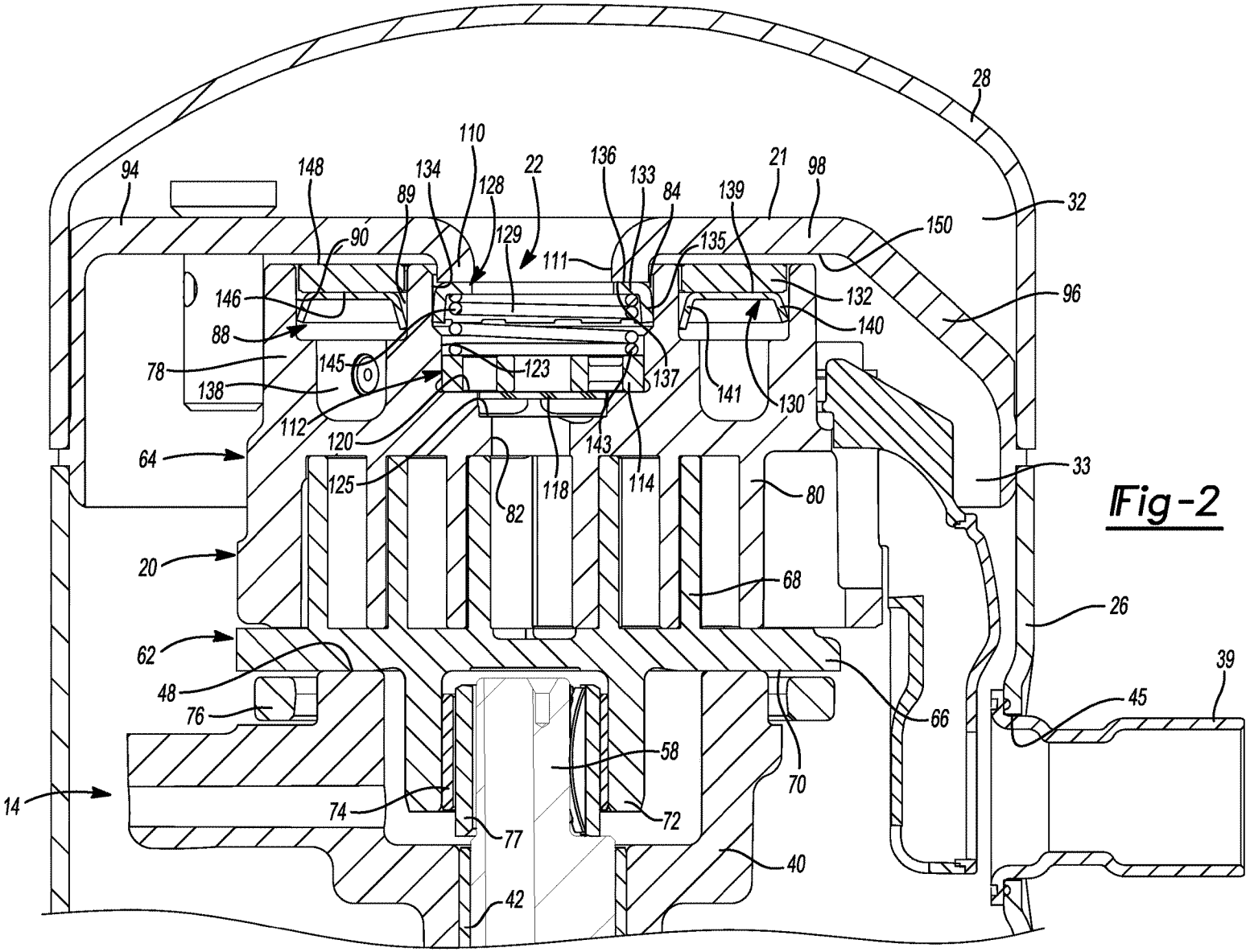
FIG. 2 is a close-up view of the compressor indicated as area 2 in FIG. 1.
Figure 4:
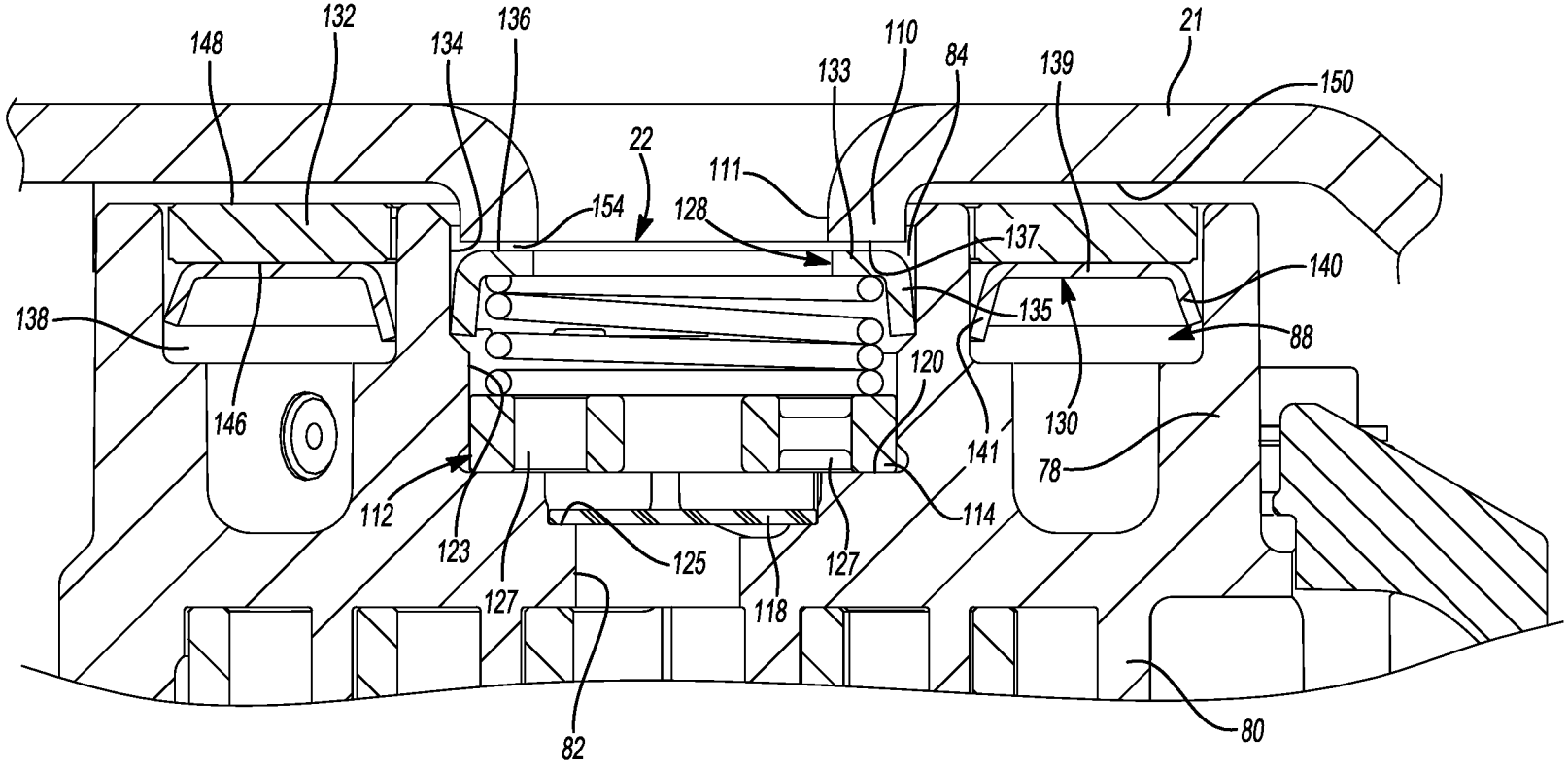
FIG. 4 is a partial cross-sectional view of the compressor in a shutdown state.

The wedge 96 may extend from and substantially around the hub 98 and may include a body portion 106 and an end portion 108. The body portion 106 extends downwardly at an angle from the hub 98 to the end portion 108. The end portion 108 extends downwardly from an end of the body portion 106. As shown in FIGS. 1, 2 and 4, the hub 98 may include a circumferentially-shaped flange or lip 110 that extends downwardly in an axial direction into the discharge recess 84 and may at least partially define a discharge passage 111 in the partition 21. In this way, the discharge passage 111 provides fluid communication between the compression mechanism 20 and the discharge chamber 32.

As shown in FIGS. 1-4, a shutdown device 112 (e.g., a discharge valve assembly) may be disposed within the discharge recess 84 and may include a housing 114 and a valve 118. The housing 114 may rest on a lower surface 120 of the discharge recess 84 and may be engaged to an outer diametrical wall 123 of the discharge recess 84. The valve 118 may be disposed between the housing 114 and the discharge passage 82 and may be moveable between a first position (FIG. 4; closed position) in which fluid in the compression pockets is prevented from flowing from the discharge passage 82 to the discharge chamber 32, and a second position (FIGS. 1 and 2; open position) in which fluid in the compression pockets is allowed to flow from the discharge passage 82 to the discharge chamber 32. The valve 118 abuts against a bottom surface 125 of the discharge recess 84 when in the first position and abuts against the housing 114 when in the second position. When the valve 118 is in the second position, compressed working fluid flows around the valve 118, through openings 127 extending through the housing 114 and into the discharge chamber 32.

The seal assembly 22 may include a first annular sealing member 128, a biasing member 129, a second annular sealing member 130 and an annular spacer 132. During operation of the compressor 10, the first annular sealing member 128 may be sealingly engaged with an inner diametrical surface 134 of the discharge recess 84 and the flange 110 of the muffler plate 21 to prevent fluid discharged from the compression mechanism 20 from flowing to the suction chamber 33 (FIGS. 1 and 2). The first annular sealing member 128 may be made of a flexible material and may be positioned between the flange 110 of the muffler plate 21 and the shutdown device 112.

The first annular sealing member 128 may include a planar first portion 133 and a second portion 135. The first portion 133 may have an upper surface 136 sealingly engaged with an axial end surface 137 of the flange 110. The second portion 135 may extend generally radially outwardly and axially downwardly from the first portion 133, and may be sealingly engaged with the inner diametrical surface 134 of the discharge recess 84. In this way, fluid in the discharge chamber 32 and fluid discharged from the compression mechanism 20 are restricted from flowing to the suction chamber 33.

The biasing member 129 (e.g., a coiled spring) may be positioned between the housing 114 and the flange 110 and may bias the first annular sealing member 128 toward the flange 110. A first end 143 of the biasing member 129 may be coupled to the housing 114 and a second end 145 of the biasing member 129 may be coupled to the first portion 133 of the first annular sealing member 128. In this way, the biasing member 129 may bias the sealing member 128 such that it is sealingly engaged with the flange 110 of the muffler plate 21.

The second annular sealing member 130 may be disposed within the annular recess 88 and may cooperate with the annular recess 88 to define an intermediate-pressure chamber 138. The intermediate-pressure chamber 138 receives fluid from the fluid pocket in the intermediate position through an intermediate passage (not shown) formed in the end plate 78. A pressure differential between the intermediate-pressure fluid in the intermediate-pressure chamber 138 and fluid in the suction chamber 33 exerts a net axial biasing force on the non-orbiting scroll 64 urging the non-orbiting scroll 64 toward the orbiting scroll 62. In this manner, the tips of the spiral wrap 80 of the non-orbiting scroll 64 are urged into sealing engagement with the end plate 66 of the orbiting scroll 62 and the end plate 78 of the non-orbiting scroll 64 is urged into sealing engagement with the tips of the spiral wrap 68 of the orbiting scroll 62. A gap may be formed between the non-orbiting scroll 64 and the muffler plate 21 (FIGS. 1, 2, and 4).

The second annular sealing member 130 may be spaced apart from the muffler plate 21 (i.e., does not contact the muffler plate 21) and may include a planar portion 139, a first end portion 140, and a second end portion 141. The first end portion 140 may extend generally radially outwardly and axially downwardly from the planar portion 139 and may be sealingly engaged with the outer surface 90 of the annular recess 88. The second end portion 141 may extend generally radially inwardly and axially downwardly from the planar portion 139 and may be sealingly engaged with the inner surface 89 of the annular recess 88. In this way, fluid in the intermediate-pressure chamber 138 is prevented from flowing to the suction chamber 33.

The spacer 132 may be at least partially disposed within the annular recess 88 and may be supported by the second annular sealing member 130. The spacer 132 includes a first or lower surface 146 and a second or upper surface 148. The first surface 146 contacts the planar portion 139 of the second annular sealing member 130 and the second surface 148 is configured to abut against a lower surface 150 of the hub 98 of the muffler plate 21. A plurality of radially extending grooves 152 may be formed in and around the second surface 148 of the spacer 132 (FIG. 3). In this way, when the compressor 10 is in a shutdown state, the first annular sealing member 128 may move downwardly in the discharge recess 84, which allows discharge gas in the discharge chamber 32 to flow toward the suction chamber 33 (FIG. 4; discharge gas in the discharge chamber 32 is allowed to flow through a gap 154 between the sealing member 128 and the flange 110, through the grooves 152 in the spacer 132 and out into the suction chamber 33).

Figure 5:
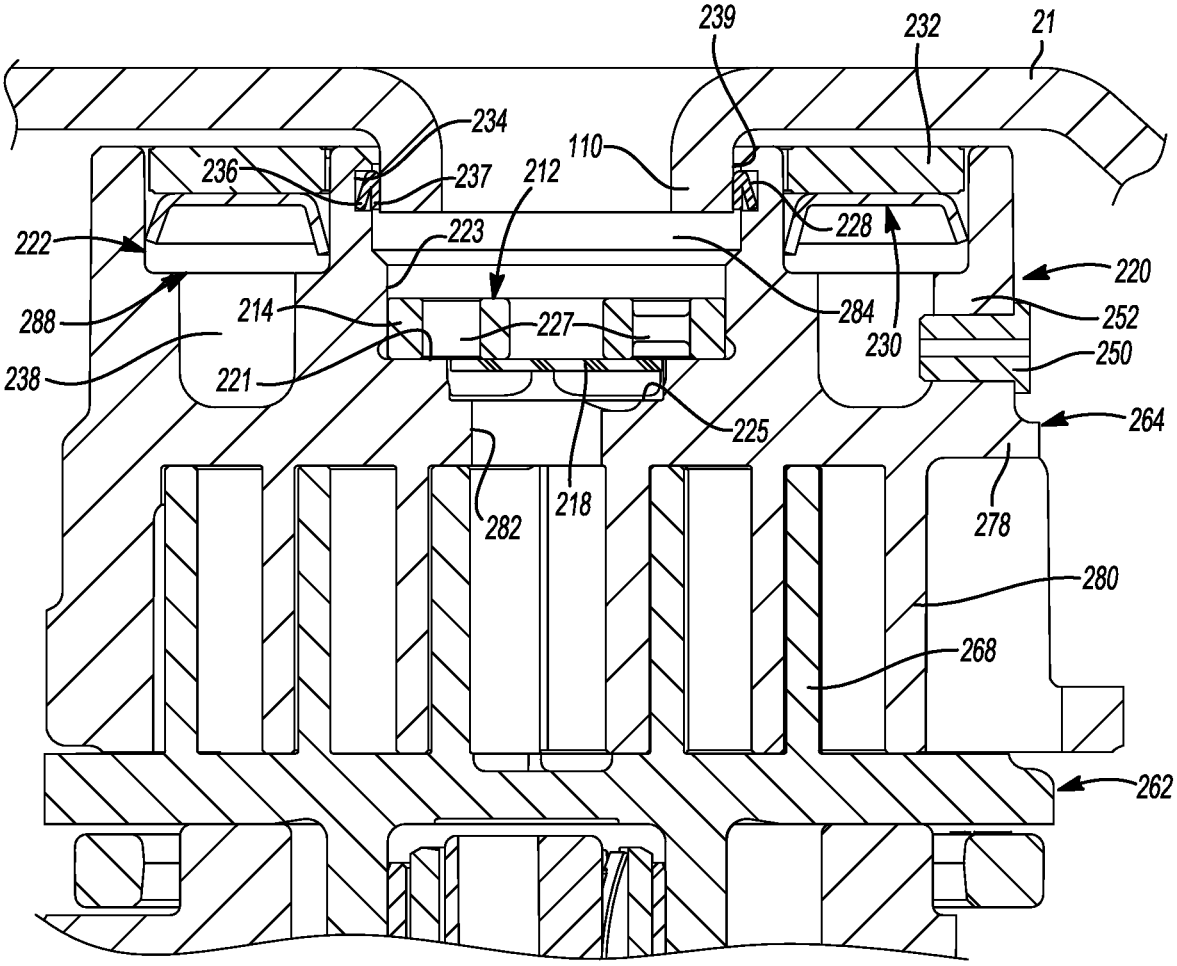
FIG. 5 is a cross-sectional view of another compression mechanism and seal assembly.

With reference to FIG. 5, another compression mechanism 220 and seal assembly 222 are provided. The compressor mechanism 220 and the seal assembly 222 may be incorporated into the compressor 10 instead of compression mechanism 20 and seal assembly 22, respectively. The structure and function of the compression mechanism 220 and seal assembly 222 may be similar or identical to the compression mechanism 20 and seal assembly 22, respectively, described above, apart from any exception noted below.

The compression mechanism 220 may include an orbiting scroll 262 and a non-orbiting scroll 264. The orbiting scroll 262 may be similar or identical to the orbiting scroll 62, described above, and therefore, will not be described again in detail. The non-orbiting scroll 264 may include an end plate 278 and a spiral wrap 280 projecting downwardly from the end plate 278. The spiral wrap 280 may meshingly engage spiral wrap 268 of the orbiting scroll 262, thereby creating a series of moving fluid pockets.

The end plate 278 may include a discharge passage 282, a discharge recess 284, and an annular recess 288. The discharge passage 282 is in communication with one of the fluid pockets at the radially inner position and allows compressed working fluid (at the discharge pressure) to flow through the discharge recess 284 and into the discharge chamber. A pressure relief valve 250 may be housed within and may extend through an outer wall 252 of the end plate 278 that defines the annular recess 288. In this way, the pressure relief valve 250 is in fluid communication with the suction chamber and an intermediate-pressure chamber 238 and may control fluid pressure in the intermediate-pressure chamber 238.

A shutdown device 212 may be disposed within the discharge recess 284 and may include a housing 214 and a valve 218. The housing 214 may rest on a lower surface 221 of the discharge recess 284 and may be engaged to an outer diametrical wall 223 of the discharge recess 284 (e.g., threadably engaged to the outer diametrical wall 223). The valve 218 may be disposed between the housing 214 and the discharge passage 282 and may be moveable between a first position (i.e., closed position) in which fluid in the compression pockets is prevented from flowing from the discharge passage 282 to the discharge chamber 32, and a second position (i.e., open position) in which fluid in the compression pockets is allowed to flow from the discharge passage 282 to the discharge chamber 32. The valve 218 abuts against a bottom surface 225 of the discharge recess 284 when in the first position and abuts against the housing 214 when in the second position (FIG. 5). When the valve 218 is in the second position, compressed working fluid flows around the valve 218, through openings 227 extending through the housing 214 and into the discharge chamber 32.

The seal assembly 222 may include a first annular sealing member 228, a second annular sealing member 230 and an annular spacer 232. The first annular sealing member 228 may be disposed within the discharge recess 284 of the end plate 78 of the non-orbiting scroll 64, and may be sealingly engaged with an inner diametrical surface 234 of the discharge recess 284 and the flange 110 of the muffler plate 21 to prevent fluid discharged from the compression mechanism 220 from flowing to the suction chamber.

The first annular sealing member 228 may be V-shaped or U-shaped and may include a first end portion 236 and a second end portion 237. The first end portion 236 may be sealingly engaged with the inner diametrical surface 234 of the discharge recess 284. The second end portion 237 may be sealingly engaged with an outer diametrical surface 239 of the flange 110 of the muffler plate 21.

The second annular sealing member 230 may be similar or identical to the sealing member 130 described above, and therefore, will not be described again in detail. The spacer 232 may be similar or identical to the spacer 132 described above, and therefore, will not be described again in detail.

Figure 6:
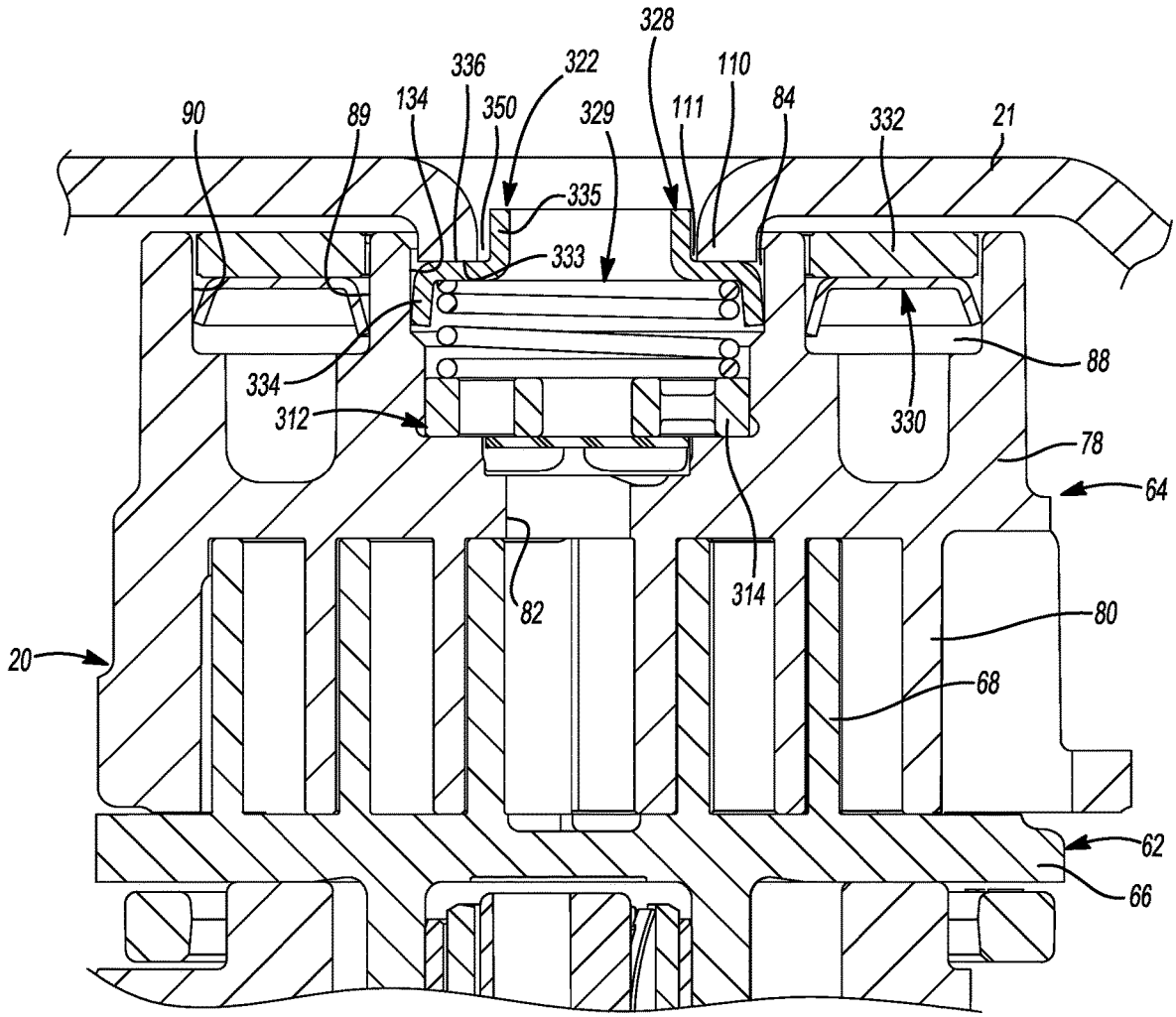
FIG. 6 is a cross-sectional view of another seal assembly.

With reference to FIG. 6, another seal assembly 322 is provided. The seal assembly 322 may be incorporated into the compressor 10 instead of seal assemblies 22, 222. The structure and function of the seal assembly 322 may be similar or identical to seal assemblies 22, 222 described above, apart from any exception noted below.

A shutdown device 312 may be disposed within the discharge recess 84. The shutdown device 312 may be similar or identical to the shutdown devices 112, 212, described above, and therefore, will not be described again in detail.

The seal assembly 322 may include a first annular sealing member 328, a biasing member 329, a second annular sealing member 330 and an annular spacer 332. The first annular sealing member 328 may be disposed within the discharge recess 84 of the end plate 78 of the non-orbiting scroll 64, and may be sealingly engaged with the inner diametrical surface 134 of the discharge recess 84 and the flange 110 of the muffler plate 21 to prevent fluid discharged from the compression mechanism 20 from flowing to the suction chamber.

The first annular sealing member 328 may include a planar portion 333, a first end portion 334 and a second end portion 335. The planar portion 333 may have an upper surface 336 sealingly engaged with the axial end surface 137 of the flange 110. The first end portion 334 may extend generally radially outwardly and axially downwardly from the planar portion 333 and may be sealingly engaged with the inner diametrical surface 134 of the discharge recess 84. The second end portion 335 may extend generally radially inwardly and axially upwardly from the planar portion 333 and may be at least partially received in the discharge passage 111 of the muffler plate 21. The second end portion 335 may also be spaced apart from the flange 110 of the muffler plate 21. When the compressor 10 in the shutdown state, discharged fluid in the discharge chamber 32 may flow to a gap 350 between the flange 110 and the second end portion 335, and may overcome the force of the biasing member 329 to push the first annular sealing member 328 downward. In this way, the discharged fluid may flow through a gap (not shown) between the flange 110 and the planar portion 333 of the sealing member 328 and out into the suction chamber 33. The biasing member 329 (e.g., a coiled spring) may be positioned between a housing 314 of the device 312 and the flange 110 and may bias the first annular sealing member 328 toward the flange 110.

The second annular sealing member 330 may be similar or identical to the sealing members 130, 230, described above, and therefore, will not be described again in detail. The spacer 332 may be similar or identical to the spacers 132, 232, described above, and therefore, will not be described again in detail.

Figure 7:
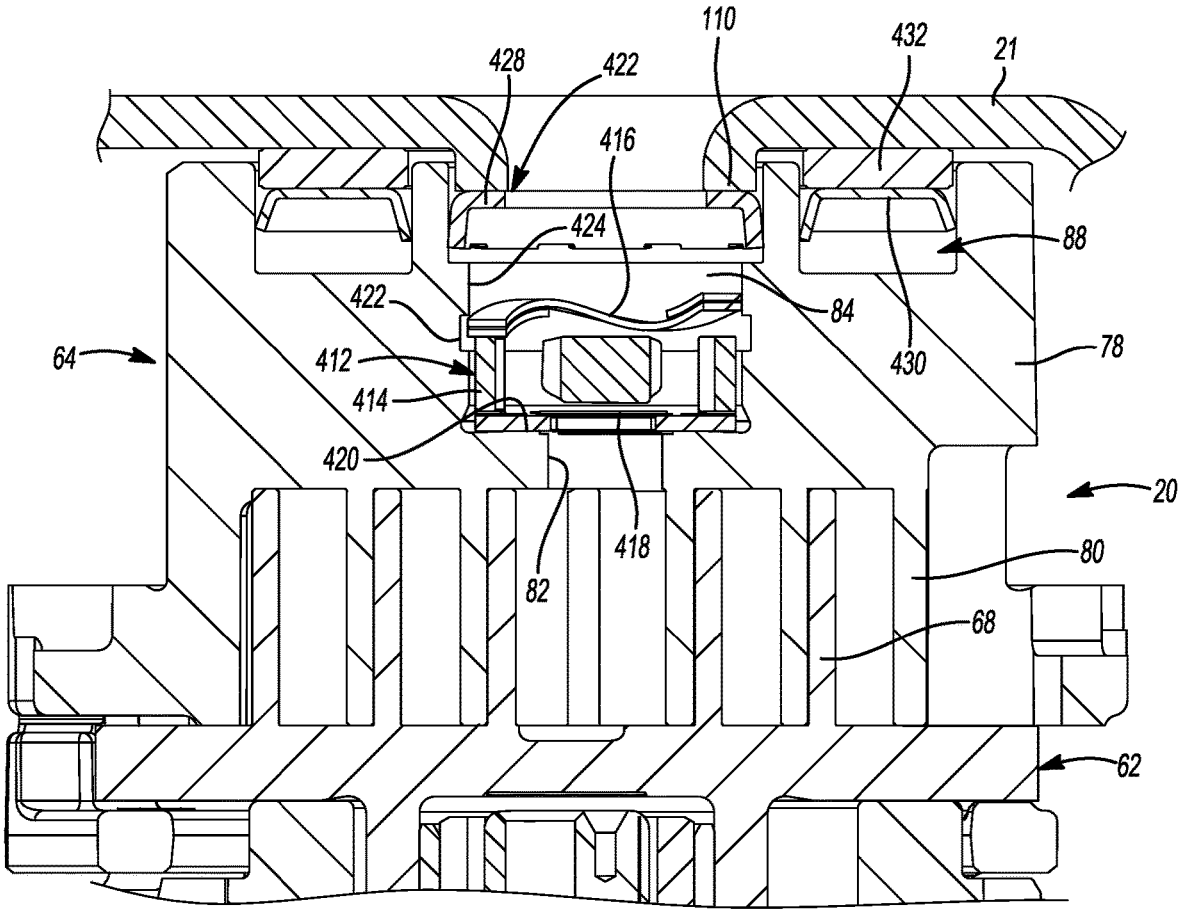
FIG. 7 is a cross-sectional view of another seal assembly.

With reference to FIG. 7, another seal assembly 422 is provided. The seal assembly 422 may be incorporated into the compressor 10 instead of seal assemblies 22, 222, 322. The structure and function of the seal assembly 422 may be similar or identical to seal assemblies 22, 222, 322 described above, apart from any exception noted below.

A shutdown device 412 may be disposed within the discharge recess 84. A shutdown device 412 may be disposed within the discharge recess 84 and may include a housing 414, a biasing member 416 and a valve 418. The housing 414 may rest on a lower surface 420 of the discharge recess 84. The biasing member 416 (e.g., a wavy spring) may be received in a groove 422 formed in an inner diametrical surface 424 of the discharge recess 84 and may bias the housing 414 against the lower surface 420 of the discharge recess 84. In this way, the housing 414 is prevented from vibrating during operation of the compressor 10. The valve 418 is moveable between a first position (i.e., closed position) in which fluid in the compression pockets is prevented from flowing from the discharge passage 82 to the discharge chamber, and a second position (i.e., open position) in which fluid in the compression pockets is allowed to flow from the discharge passage 82 to the discharge chamber.

The seal assembly 422 may include a first annular sealing member 428, a second annular sealing member 430 and an annular spacer 432. The first sealing member 428 may be similar or identical to the sealing member 130 described above, and therefore, will not be described again in detail. The second sealing member 430 may be similar or identical to the sealing members 130, 230, 330 described above, and therefore, will not be described again in detail. The spacer 432 may be similar or identical to the spacers 132, 232, 332 described above, and therefore, will not be described again in detail.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell defining a first pressure region and a second pressure region;

a muffler plate separating the first pressure region and the second pressure region;

a first scroll member disposed within the shell and including a first end plate and a first scroll wrap, the first end plate defining an annular recess and a discharge recess, the discharge recess in communication with the first pressure region;

a second scroll member including a second end plate and a second scroll wrap, the second scroll wrap meshingly engaging the first scroll wrap to define a compression chamber therebetween;

a first sealing member at least partially disposed in the discharge recess and fluidly separating the first and second pressure regions from each other;

a second sealing member at least partially disposed in the annular recess, the second sealing member forming a third pressure region that is fluidly isolated from the first and second pressure regions;

a spacer at least partially disposed within the annular recess and including a first surface contacting the second sealing member and a second surface configured to contact the muffler plate, wherein the spacer includes a radially extending groove that allows working fluid to flow between the spacer and the muffler plate while the second surface of the spacer is in contact with the muffler plate;

a discharge valve assembly disposed within the discharge recess of the first scroll member; and a biasing member disposed within the discharge recess, wherein the biasing member is compressed between the discharge valve assembly and the first sealing member, wherein the first sealing member has an L-shaped cross section and sealingly contacts the muffler plate, wherein the second sealing member has a U-shaped cross section.

2. The compressor of claim 1, wherein the second sealing member includes a first end portion sealingly engaged with an inner wall of the annular recess and a second end portion sealingly engaged with an outer wall of the annular recess.

3. The compressor of claim 2, wherein the second sealing member includes a planar central portion, and wherein the first end portion extends radially inwardly and axially downwardly from the planar central portion and the second end portion extends radially outwardly and axially downwardly from the planar central portion.

4. The compressor of claim 1, wherein the muffler plate includes a flange at least partially extending into the discharge recess and partially defining a discharge opening that provides discharge gas from the discharge recess to the first pressure region.

5. The compressor of claim 1, wherein the first and second sealing members are made of a flexible material.

6. The compressor of claim 1, wherein the first pressure region is a discharge pressure chamber, the second pressure region is a suction pressure chamber and the third pressure region is an intermediate pressure chamber.

7. The compressor of claim 1, wherein the second sealing member is spaced apart from the muffler plate.

8. The compressor of claim 1, wherein the discharge valve assembly includes a valve that is movable within the discharge recess and a housing that is stationary within the discharge recess, and wherein the biasing member contacts the first sealing member and the housing of the discharge valve assembly.

9. A compressor comprising:

a shell defining a first pressure region and a second pressure region;

a muffler plate separating the first pressure region and the second pressure region;

a first scroll member disposed within the shell and including a first end plate and a first scroll wrap, the first end plate defining an annular recess and a discharge recess, the discharge recess in communication with the first pressure region;

a second scroll member including a second end plate and a second scroll wrap, the second scroll wrap meshingly engaging the first scroll wrap to define a compression chamber therebetween;

a first sealing member at least partially disposed in the discharge recess and fluidly separating the first and second pressure regions from each other; and a second sealing member at least partially disposed in the annular recess and spaced apart from the muffler plate, the second sealing member forming a third pressure region that is fluidly isolated from the first and second pressure regions;

a spacer at least partially disposed within the annular recess and including a first surface contacting the second sealing member and a second surface configured to contact the muffler plate, wherein the spacer includes radially extending grooves that allow working fluid to flow between the muffler plate and the spacer when the second surface of the spacer is in contact with the muffler plate;

a discharge valve assembly disposed within the discharge recess of the first scroll member; and a biasing member disposed within the discharge recess, wherein the biasing member is compressed between the discharge valve assembly and the first sealing member, wherein the muffler plate includes a flange at least partially extending into the discharge recess and partially defining a discharge opening that provides discharge gas from the discharge recess to the first pressure region, wherein the first sealing member includes a first portion and a second portion that cooperate to define an L-shaped cross section, wherein the first portion extends radially inward from the second portion and sealingly contacts an axial end surface of the flange of the muffler plate, and wherein the second portion extends axially downward from the first portion and sealingly contacts an inner diametrical surface of the discharge recess, wherein the second sealing member has a U-shaped cross section.

10. The compressor of claim 9, wherein the discharge valve assembly includes a housing and a movable valve, wherein the housing includes a plurality of openings, wherein the valve is movable between a first position in which fluid in the compression chamber is prevented from flowing through the openings in the housing to the first pressure region and a second position in which fluid in the compression chamber is allowed to flow through the openings in the housing to the first pressure region.

11. The compressor of claim 9, further comprising a pressure relief valve housed within and extending through an outer wall of the first end plate that defines the annular recess, the pressure relief valve in fluid communication with the third pressure region to control fluid pressure in the third pressure region.

12. The compressor of claim 9, wherein the first sealing member is made of a flexible material.

13. The compressor of claim 9, wherein the biasing member contacts the first sealing member and the housing of the discharge valve assembly.

14. A compressor comprising:

a shell defining a first pressure region and a second pressure region;

a muffler plate separating the first pressure region and the second pressure region;

a first scroll member disposed within the shell and including a first end plate and a first scroll wrap, the first end plate defining an annular recess and a discharge recess, the discharge recess in communication with the first pressure region;

a second scroll member including a second end plate and a second scroll wrap, the second scroll wrap meshingly engaging the first scroll wrap to define a compression chamber therebetween;

a first sealing member at least partially disposed in the discharge recess and fluidly separating the first and second pressure regions from each other; and a second sealing member at least partially disposed in the annular recess and spaced apart from the muffler plate, the second sealing member forming a third pressure region that is fluidly isolated from the first and second pressure regions, wherein the muffler plate includes a flange at least partially extending into the discharge recess and partially defining a discharge opening that provides discharge gas from the discharge recess to the first pressure region, and wherein the first sealing member includes an end portion that at least partially extends into the discharge opening of the muffler plate, and wherein the first sealing member is moveable downwardly when the compressor is in a shutdown state to allow discharge gas in the first pressure region to flow toward the second pressure region.

15. The compressor of claim 14, further comprising a spacer at least partially disposed within the annular recess and supported by the second sealing member, the spacer including radially extending grooves that allow discharge gas in the first pressure region to flow toward the second pressure region when the compressor is in the shutdown state.

16. The compressor of claim 14, further comprising a biasing member disposed within the discharge recess and biasing the first sealing member toward the flange of the muffler plate, discharge fluid in the first pressure region overcoming the biasing force of the biasing member when the compressor is in the shutdown state to allow discharge gas in the first pressure region to flow toward the second pressure region.

* * * * *